US006935629B2

(12) United States Patent
Asada

(10) Patent No.: US 6,935,629 B2
(45) Date of Patent: Aug. 30, 2005

(54) SHEET GUIDING SYSTEM AND IMAGE FORMING DEVICE WITH SHEET GUIDING SYSTEM

(75) Inventor: Tetsuo Asada, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/774,595

(22) Filed: Feb. 10, 2004

(65) Prior Publication Data

US 2004/0188923 A1 Sep. 30, 2004

(30) Foreign Application Priority Data

Mar. 26, 2003 (JP) ..... 2003-085196

(51) Int. Cl.[7] ..... B65H 1/06
(52) U.S. Cl. ..... 271/171
(58) Field of Search ..... 271/171, 223; 347/104; 399/393, 405

(56) References Cited

U.S. PATENT DOCUMENTS 5,292,117 A * 3/1994 Takagi et al. ..... 271/234
5,927,707 A * 7/1999 Miura ..... 271/171
6,435,499 B1 8/2002 Tomatsu
6,619,796 B2 * 9/2003 Rasmussen et al. ..... 347/104
2003/0174194 A1 * 9/2003 Tsutsui et al. ..... 347/104
2004/0070138 A1 * 4/2004 Ishikuro ..... 271/171

* cited by examiner

*Primary Examiner*—David H. Bollinger
(74) *Attorney, Agent, or Firm*—Oliff & Berridge, PLC

(57) ABSTRACT

A sheet guiding system guides different sized sheets so as to be fed in a first direction. Sheets stacked on a sheet tray are guided by selectively using a fixed guide, a first movable guide, and a second movable guide. The fixed guide is provided on the sheet tray immovably in a second direction perpendicular to the first direction. The first and second movable guides are provided on the sheet tray and are movable in the second direction. The fixed guide and the first movable guide are used to sandwich and guide the sheets that have a first dimension in the second direction equal to or larger than a predetermined dimension, which is, for example, a width of an A4 size sheet. The first and second movable guides are used to sandwich and guide the sheets that have a second dimension in the second direction smaller than the predetermined dimension.

33 Claims, 10 Drawing Sheets

RELATED ART

SHEET GUIDING SYSTEM AND IMAGE FORMING DEVICE WITH SHEET GUIDING SYSTEM

BACKGROUND OF THE INVENTION

1. Field of Invention

The invention relates to a sheet guiding system and an image forming device having a sheet guiding system.

2. Description of Related Art

U.S. Pat. No. 6,435,499 discloses a conventional sheet guiding system of a center registration type in which different sized sheets are guided while their center positions are used as a reference. FIGS. 10A and 10B show a center registration type sheet guiding system similar to the one disclosed in U.S. Pat. No. 6,435,499. FIGS. 10A and 10B are a plan view and a sectional side view, respectively, of a conventional center registration type sheet feed cassette 100. FIG. 10A shows a positional relation between sheet guides and different sized sheets in the sheet feed cassette 100. Sheets 3 are sandwiched and guided by sheet guides that are movable in a sheet width direction. Large sized sheets are regulated by moving first and second movable guides 101, 102 inward, while small sized sheets are regulated by moving the first and second movable guides 101, 102 outward. In FIG. 10A, the first and second movable guides 101, 102 are placed farthest away from each other when guiding letter (LTR) and legal (LGL) size sheets, and placed close to each other with respect to the center line X, as shown by dash-double-dot lines, when guiding postcard sized sheets. The center positions of different sized sheets are the same in the sheet feed cassette 100. A rear guide 103 is also provided at the rear of a recess 100*a* to align the rear edges of the sheets. The rear guide 103 is movable in a sheet feed direction that is parallel to the center line X of different sized sheets. Sheets 3 are fed one by one by a sheet feed roller, and a portion 104 to receive a pressing force from the sheet feed roller is provided at the bottom of the sheet feed cassette 100.

SUMMARY OF THE INVENTION

In the center registration type sheet guiding system, however, the movable sheet guides that sandwich the sheets are likely to wobble because the sheet guides are movable. As a result, shifting in the sheet guiding position, sheet skewing, or printing deviation on a sheet may be caused. Large sized sheets are more likely to suffer such problems if the movable sheet guides are relatively short in the sheet feed direction.

Side registration type sheet guiding systems are also known, in which different sized sheets are guided with their side edges used as a reference. In a sheet guiding system of this type, a sheet feed roller is typically provided on one side, for example, at a position corresponding to a center line of the smallest sized sheet placed against a fixed side sheet guide. In this case, as the size of a sheet increases, a sheet becomes more likely to rotate or curl against the fixed side sheet guide when being fed by the sheet feed roller, resulting in sheet skewing. Also, a frictional force from the sheet feed roller is likely to become applied unevenly to a topmost sheet. As a result, a failure in the separation or feeding of the sheet occurs. Although these problems can be solved by providing a plurality of sheet feed rollers, the manufacturing cost will thus increase.

The invention addresses, among other things, the forgoing problems and provides a sheet guiding system that is simple in structure and yet able to prevent shifting in a sheet guiding position, sheet skewing, and deviation of a printed image. The invention also simplifies duplex feeding so that an adjustment does not have to be made in order to compensate for variable widths of different sheets when a sheet returns to an image forming station.

One exemplary aspect of the invention is to provide a sheet guiding system that guides sheets to be fed in a first direction. The sheet guiding system includes a sheet tray on which sheets are stacked, a fixed guide member and a first movable guide member, and a second movable guide member. The fixed guide member is provided on the sheet tray and is immovable in a second direction perpendicular to the first direction. The first and second movable guide members are provided on the sheet tray movably in the second direction perpendicular to the first direction. The fixed guide member and the first movable guide member are used to sandwich and guide the sheets that have a first dimension, in the second direction, equal to or larger than a predetermined dimension, and the first movable guide member and the second movable guide member are used to sandwich and guide the sheets that have a second dimension, in the second direction, smaller than the predetermined dimension.

Another exemplary aspect of the invention is to provide an image forming device that includes a printhead printing an image on sheets and a sheet guiding system that guides the sheets to be fed in a first direction for printing by the printhead. The sheet guiding system includes a sheet tray on which sheets are stacked, a fixed guide member and a first movable guide member, and a second movable guide member. The fixed guide member is provided on the sheet tray and is immovable in a second direction perpendicular to the first direction. The first and second movable guide members are provided on the sheet tray and are movable in the second direction perpendicular to the first direction. The fixed guide member and the first movable guide member are used to sandwich and guide the sheets that have a first dimension, in the second direction, equal to or larger than a predetermined dimension, and the first movable guide member and the second movable guide member are used to sandwich and guide the sheets that have a second dimension, in the second direction, smaller than the predetermined dimension.

BRIEF DESCRIPTION OF THE DRAWINGS

A preferred embodiment of the invention will be described in detail with reference to the following figures, in which like elements are labeled with like numbers in which.

DETAILED DESCRIPTION OF PREFERRED EMBODIMENTS

Figure 1:
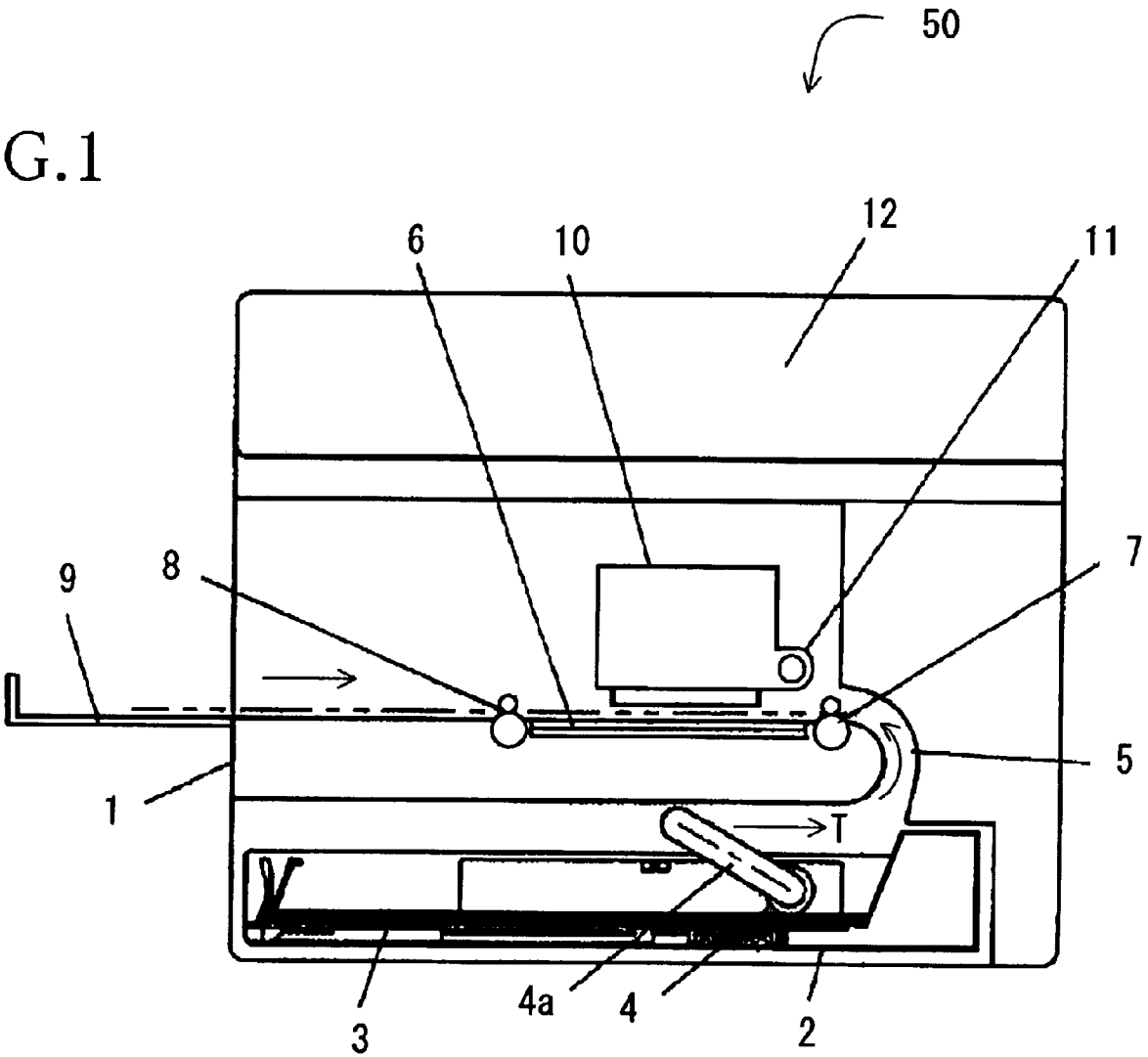
FIG. 1 is a vertical sectional side view showing essential parts of an image forming device according to one embodiment of the invention.

One embodiment of the invention will be described with reference to the accompanying drawings. FIG. 1 is a vertical sectional side view showing essential parts of an image forming device 50 according to one embodiment of the invention. In the image forming device shown in FIG. 1, sheets are fed from a lower portion thereof. A sheet feed cassette 2 is disposed at the bottom of a housing 1 to accommodate a stack of sheets 3 therein. A sheet feed roller 4 and an arm 4*a* are provided in the housing 1. The sheet feed roller 4 is lightly pressed by the arm 4*a* against the upper surface of the stack of sheets 3.

A platen 6 is disposed above the sheet feed cassette 2 with a sheet path 5 interposed therebetween. A pair of linefeed rollers 7 and a pair of ejecting rollers 8 are disposed at the front and rear of the platen 6, respectively. An output roller 9 is disposed behind the ejecting rollers 8 to project from the housing 1.

A printhead 10 that prints on the sheet 3 is disposed right above the platen 6 and is guided along a carriage guide shaft 11 to reciprocate in a direction perpendicular to the sheet path 5. A document reader 12 is disposed at an upper portion of the housing 1.

As the sheet feed roller 4 rotates, a topmost sheet 3 is fed one by one with a frictional force of the sheet feed roller 4 and is fed upward along the sheet path 5 as shown by the arrow (in a sheet feed direction T in the sheet feed cassette 2). Then, the sheet 3 is fed to the platen 6 by the rotation of the linefeed rollers 7, and is guided to the output tray 9 by the rotation of the ejecting rollers 8. When the sheet 3 is carried over the platen 6, the printhead 10 reciprocates along the carriage guide shaft 11 to print an image read by the document reader 12 on the sheet 3.

Figure 2:
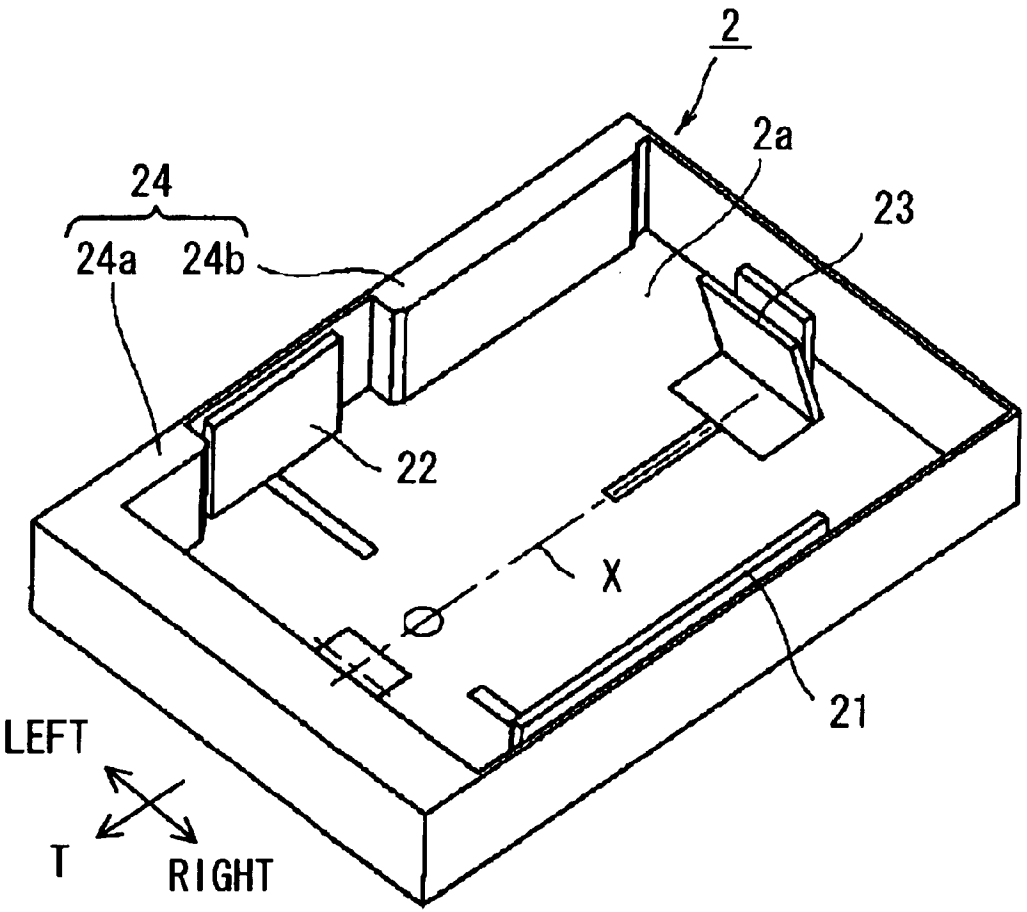
FIG. 2 is a perspective view of a sheet feed cassette used in the image forming device according to the one embodiment of the invention.

FIG. 2 is a perspective view of the sheet feed cassette 2 as a sheet guiding system used for the above-described image forming device in which sheets are fed from a lower portion thereof. The sheet feed cassette 2 used for such an image forming device is described hereinafter, by way of example. A sheet feed cassette 130 (FIG. 9) used for an image forming device in which sheets are fed from a upper portion thereof has basically the same structure as that of the sheet feed cassette 2, except that the sheet feed cassette 130 is not provided with a rear guide, which is to be described later.

In FIG. 2, the sheet feed cassette 2 has a generally rectangular box shape and is formed with a recess 2*a* open upward to accommodate a stack of sheets 3 therein. A first movable guide 21 and a second movable guide 22 are disposed in the recess 2*a* at the right and left of the sheet feed direction T to sandwich and guide the sheets 3. The first and second movable guides 21, 22 are movable, in association with each other, in the right-left direction perpendicular to the sheet feed direction T while maintaining a positional relation with respect to the center line X of the sheet feed cassette 2 that is parallel to the sheet feed direction T. Hereinafter, the sheet feed cassette 2 will be described using the terms "right" and "left" as shown from the downstream side of the sheet feed direction T (i.e., when viewing the plan view of the sheet feed cassette of FIG. 3).

A rear guide 23 is disposed in the recess 2*a* at the rear of the sheet feed cassette 2 in order to press the sheets 3 against a front panel of the sheet feed cassette 2 and to align the rear edges of the sheets 3. The rear guide 23 is movable along the center line X in the sheet feed direction T. In addition, a fixed guide 24 is provided on the same side as the second movable guide 22 (on the left side) at an inner surface of the sheet feed cassette 2 and extends in the sheet feed direction T along almost the entire length of the sheet feed cassette 2. The fixed guide 24 includes a first fixed guide 24*a* and a second fixed guide 24*b* that provides a space that allows the second movable guide 22 to enter therebetween. The first and second fixed guides 24*a*, 24*b* are away from each other in the sheet feed direction T.

At least a part of the fixed guide 24 (the first fixed guide 24*a* in this embodiment) is disposed downstream of the first movable guide 21 with respect to the sheet feed direction T. By providing a guide member (the first fixed guide 24*a*) at a position as forward as possible with respect to the sheet feed direction T, sheets 3 are guided in a stable manner. Sheets 3 are also stably fed as the sheets 3 remain in contact with the first fixed guide for a predetermined distance after the sheets are initially fed in the sheet feeding direction.

Figures 3A, 3B:
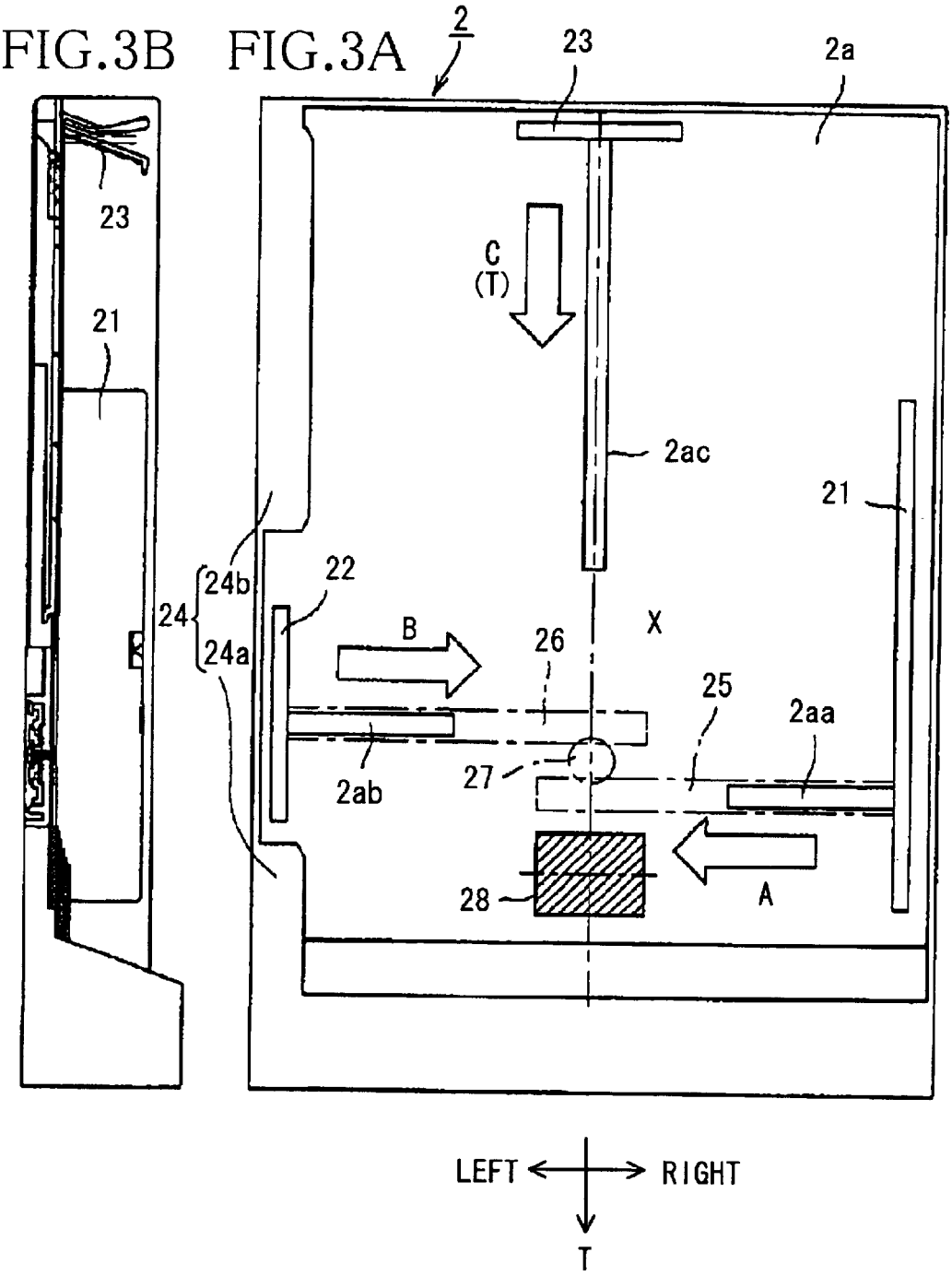
FIG. 3A is a plan view of the sheet feed cassette that shows movements of the sheet guides.
FIG. 3B is a sectional side view of the sheet feed cassette.

FIGS. 3A and 3B are a plan view and a sectional side view of the sheet feed cassette 2, respectively. FIG. 3A shows the movements of sheet guides provided in the sheet feed cassette 2. The above-described guides 21–24 are collectively referred to as sheets guides. As describe above, the first and second movable guides 21, 22 are movable, in association with each other, in the right-left direction perpendicular to the sheet feed direction T while maintaining a positional relation with respect to the center line X that is parallel to the sheet feed direction T. In this embodiment, the center line X of the sheet feed cassette 2 is determined to correspond with the center position of postcard size sheets.

More specifically, when the first movable guide 21 is moved inward as shown by arrow A (leftward), the second movable guide 22 is moved, in association with the first movable guide 21, inward (rightward) in the opposite direction as shown by arrow B by the same distance. With this structure, the first and second movable guides 21, 22 guide the sheets 3 while centering the sheets 3 in the sheet feed cassette 2. When the first and second movable guides 21, 22 are moved in directions opposite to arrows A and B, they are moved, in association with each other, outward with respect to the center line X.

The first movable guide 21 slides along a slit 2*aa* that is provided in the bottom surface of the sheet feed cassette 2 to extend in the right-left direction perpendicular to the sheet feed direction T. The first movable guide 21 is linked, via the slit 2*aa*, with a rack 25 provided at the back surface of the sheet feed cassette 2. Likewise, the second movable guide 22 slides along a slit 2*ab* that is provided in the bottom surface of the sheet feed cassette 2 to extend in the right-left direction perpendicularly to the sheet feed direction T. The second movable guide 22 is linked, via the slit 2*ab*, with a rack 26 provided at the back surface of the sheet feed cassette 2. The racks 25, 26 are to be described later.

The rear guide 23 is movable independently from the first and second movable guides 21, 22 in a direction shown by arrow C and in the opposite direction, parallel to the sheet feed direction T. The rear guide 23 slides along a slit 2*ac* provided in the bottom surface of the sheet feed cassette 2 to extend in alignment with the center line X in the sheet feed direction T. In addition, a pinion 27 is provided to engage with the racks 25, 26. A shaded portion 28 is a portion provided on the bottom surface of the sheet feed cassette 2 to receive a pressing force from the sheet feed roller 4.

Figure 4:
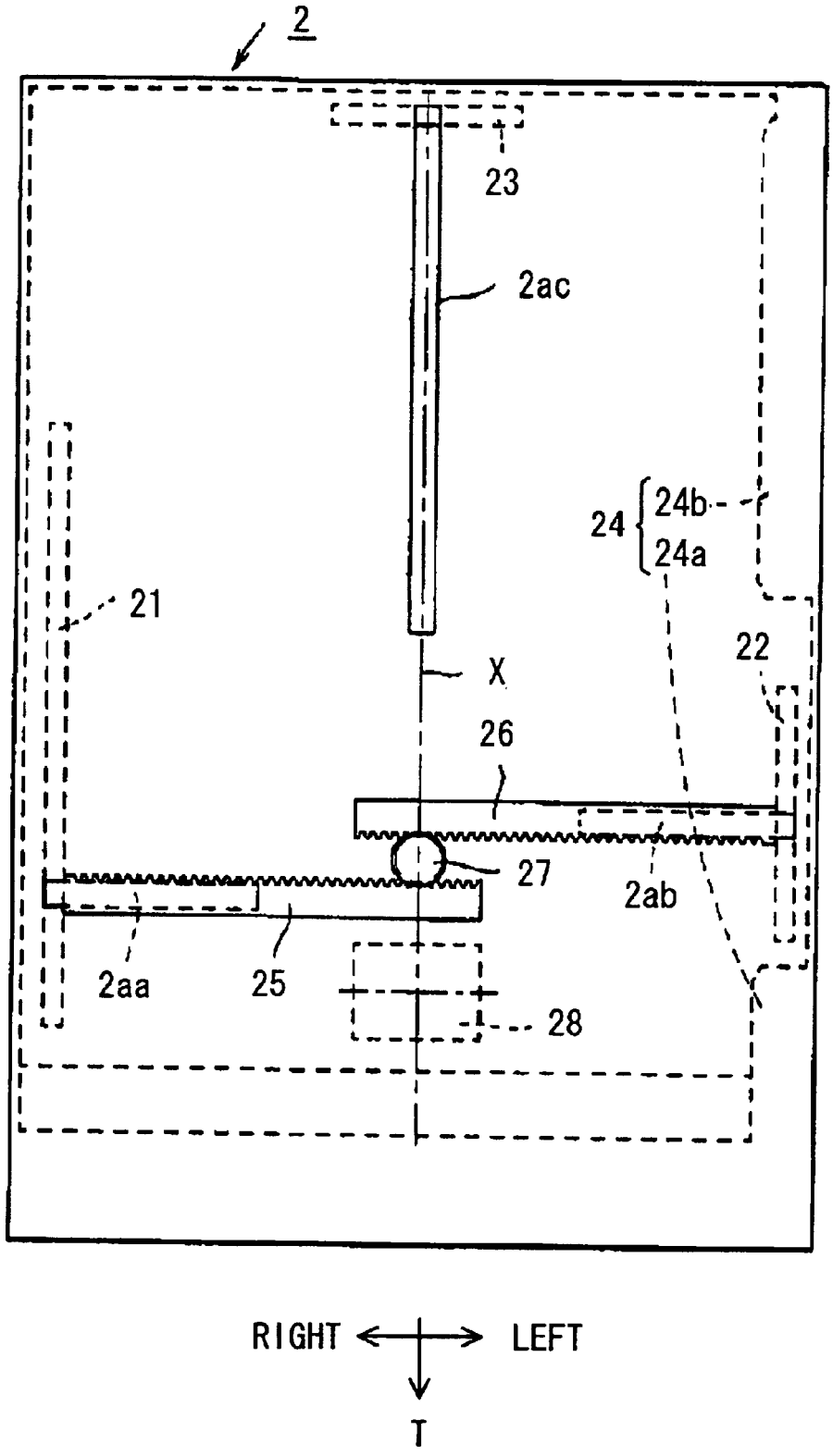
FIG. 4 is a bottom view of the sheet feed cassette that shows a mechanism of the sheet guides.

FIG. 4 is a bottom view of the sheet feed cassette 2 that shows a mechanism of the sheet guides. As shown in FIG. 4, the rack 25 that is linked with the first movable guide 21 via the slit 2*aa* extends, in the right-left direction perpendicularly to the sheet feed direction T, to one of opposed side surfaces of the sheet feed cassette 2. The rack 26 that is linked with the second movable guide 22 via the slit 2*ab* extends in the right-left direction to the other of the opposed side surfaces of the sheet feed cassette 2.

The pinion 27 is rotatably provided on the center line X on the back surface of the sheet feed cassette 2. The rack 25 engages with the pinion 27 from the front while the rack 26 engages with the pinion 27 from the rear. For example, when the rack 25 moves rightward (as shown in FIG. 4), perpendicularly to the sheet feed direction T, the pinion 27 rotates in association with the rack 25, and when the rack 26 moves leftward (as shown in FIG. 4), perpendicularly to the sheet feed direction T, the pinion 27 rotates in association with the rack 26. The racks 25, 26 move in opposite directions. With this structure, the first and second movable guides 21, 22 are movable in association with each other in the right-left direction, perpendicularly to the sheet feed direction T while maintaining a positional relation with respect to the center line X, which is parallel to the sheet feed direction T.

Figure 5:
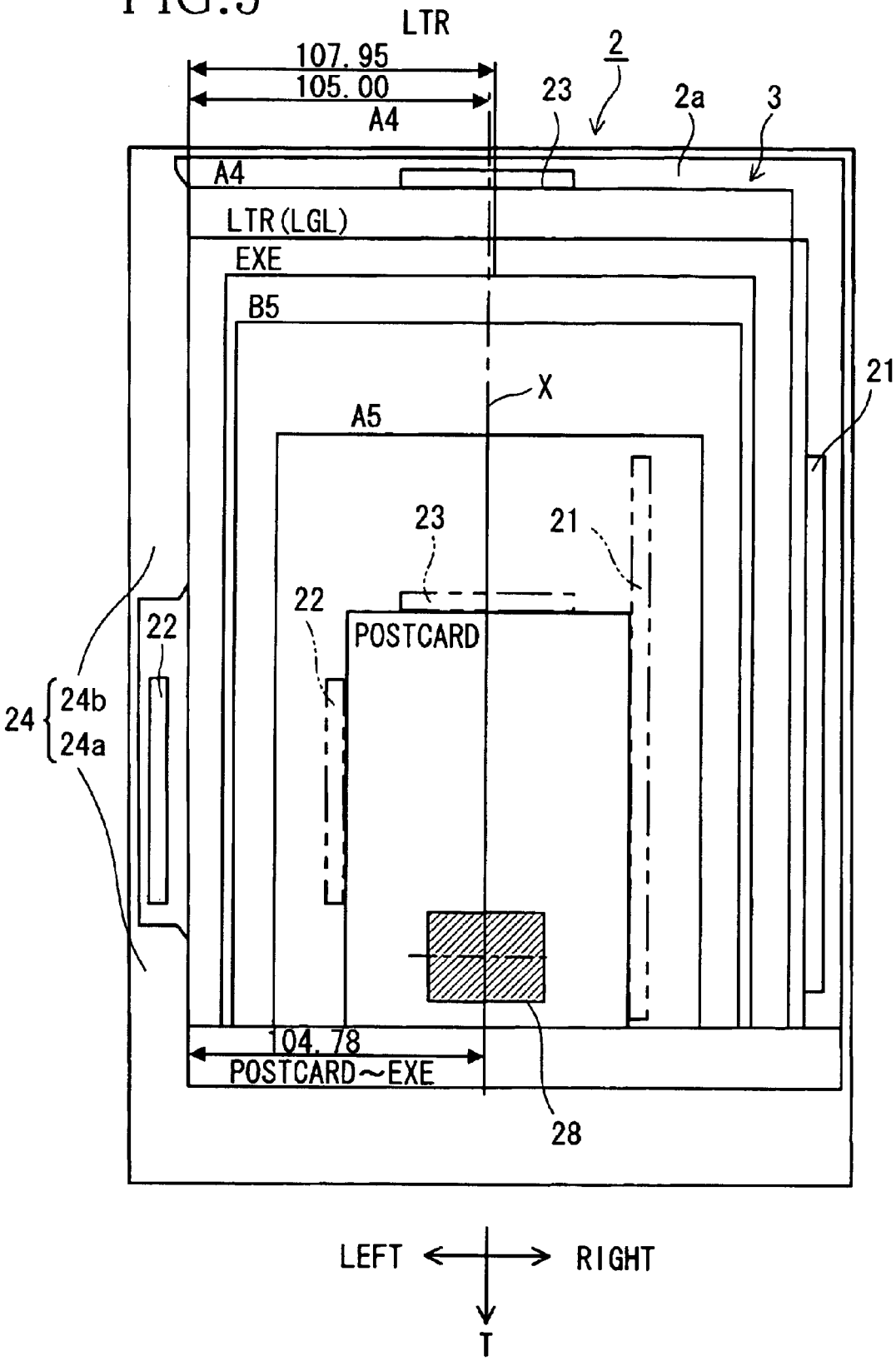
FIG. 5 is a plan view of the sheet feed cassette that shows positional relations between the sheet guides and different sized sheets.

FIG. 5 is a plan view of the sheet feed cassette 2 that shows positional relations of the sheet guides and different sized sheets in the sheet feed cassette 2. As shown in FIG. 5, letter (LTR), legal (LGL), and A4 size sheets 3 are sandwiched and guided by the fixed guide 24 and the first movable guide 21.

As shown by solid lines in FIG. 5, the second movable guide 22 is retracted between the first and second fixed guides 24*a*, 24*b* of the first fixed guide 24, leftward away from the sheets 3. When the sheets 3 having a width equal to or larger than the width of a frequently used predetermined sized sheet (A4 size sheet in this embodiment) are guided, side edges (right side edges) of the sheets 3 are regulated by the fixed guide 24. Thus, the sheets 3 are guided stably by the wobble-free fixed guide 24. Because the fixed guide 24 is divided by the second movable guide 22, the sheets 3 are guided at three portions defined by the first fixed guide 24*a*, the second fixed guide 24*b*, and the first movable guide 21. Specifically, each sheet 3 is guided with its one side edge regulated at upper and lower portions and its other side edge regulated at a central portion. In this case, the sheet 3 is guided more stably with less load applied thereto than in the case where the sheet 3 is guided by sheet guides that are elongated over the opposed side edges of the sheet 3.

Also, when the sheets 3 have a width equal to or larger than the width of the frequently used predetermined sized sheet, the left edge of the sheet 3 is positioned against the fixed guide 24. As such, duplex feeding is simplified because an adjustment does not have to be made in order to compensate for the variable widths of sheets 3 that have a width equal to or larger than the width of the predetermined sized sheet. An adjustment does not have to be made because the left edge of the sheet 3 is placed against the fixed guide 24.

On the other hand, the sheets 3 having a width smaller than the predetermined sized sheet (A4 size sheet in this embodiment), such as executive (EXE), B5, A5, and postcard size sheets 3, are sandwiched and guided by the first movable guide 21 and the second movable guide 22 as in a conventional center registration type sheet guiding system. In this case, these sheets 3 are small relative to the length of the sheet guides and are less likely to be affected by the wobble of the sheet guides. As shown in FIG. 5, postcard size sheets 3 are guided by the first and second movable guides 21, 22 and the rear guide 23 that are shown by dash-double-dot lines. The first movable guide 21 is longer than the second movable guide 22 and extends toward upstream and downstream sides in the sheet feed direction T. Each sheet 3 is guided with its one side edge regulated by the first movable guide 21 and with its other side regulated at a central portion by the second movable guide 22. Thus, although the positional relation of the first and second movable guides 21, 22 is opposite to that of the fixed guide 24 and the first movable guide 21 used for guiding the sheets 3 is equal to or larger than the predetermined size, the same effects are obtained and stable sheet guiding is enabled.

In FIG. 5, the center positions of different sized sheets 3 are shown by distances (design dimensions) between the fixed guide 24 and the center positions of different sized sheets. Specifically, the center positions of different sized sheets 3 are as follows:

| | |
|---|---|
| Postcard size to executive (EXE) size: | 104.75 mm |
| A4 size: | 105.00 mm |
| Letter (LTR) size and legal (LGL) size: | 107.95 mm |

Although the center positions of sheets vary slightly depending on the sheet size, these center positions are determined so as not to require an excessive stroke of movement for the movable guides 21, 22. In other words, the center positions are determined to enable switching between center registration sheet guiding and side registration sheet guiding with a minimum movement of the movable guides 21, 22. Consequently, the sheet feed cassette 2 can be made compact. Further, the center positions of different sized sheets fall within a portion contacted by the sheet feed roller 28. The sheet feed roller 28 frictionally contacts a center front portion of a sheet of any size. Thus, a frictional force from the sheet feed roller 28 is likely to be applied evenly to the sheet, enabling stable sheet feeding.

Figure 6:
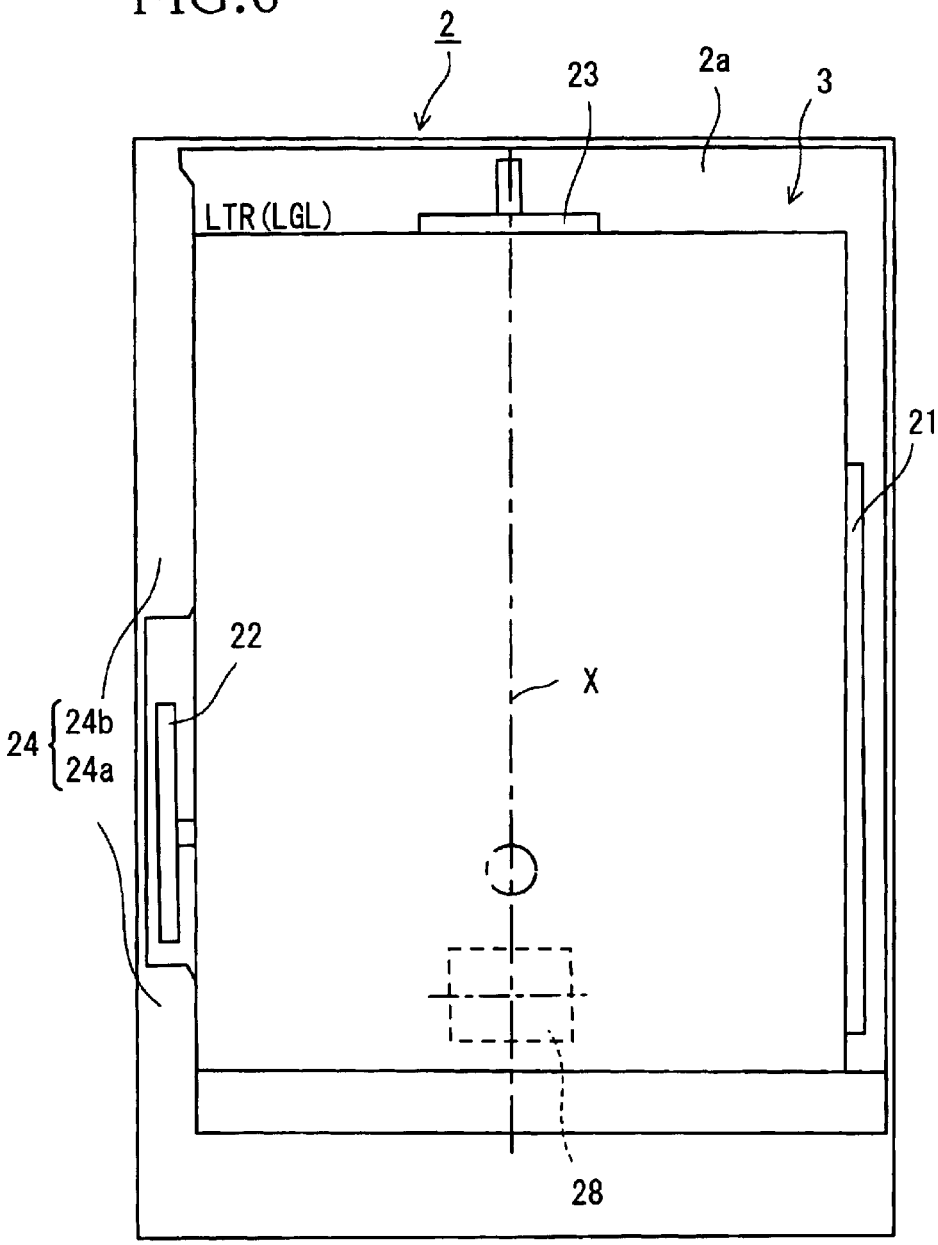
FIG. 6 is a plan view of the sheet feed cassette that shows a positional relation between the sheet guides and letter (LTR) and legal (LGL) size sheets.
Figure 7:
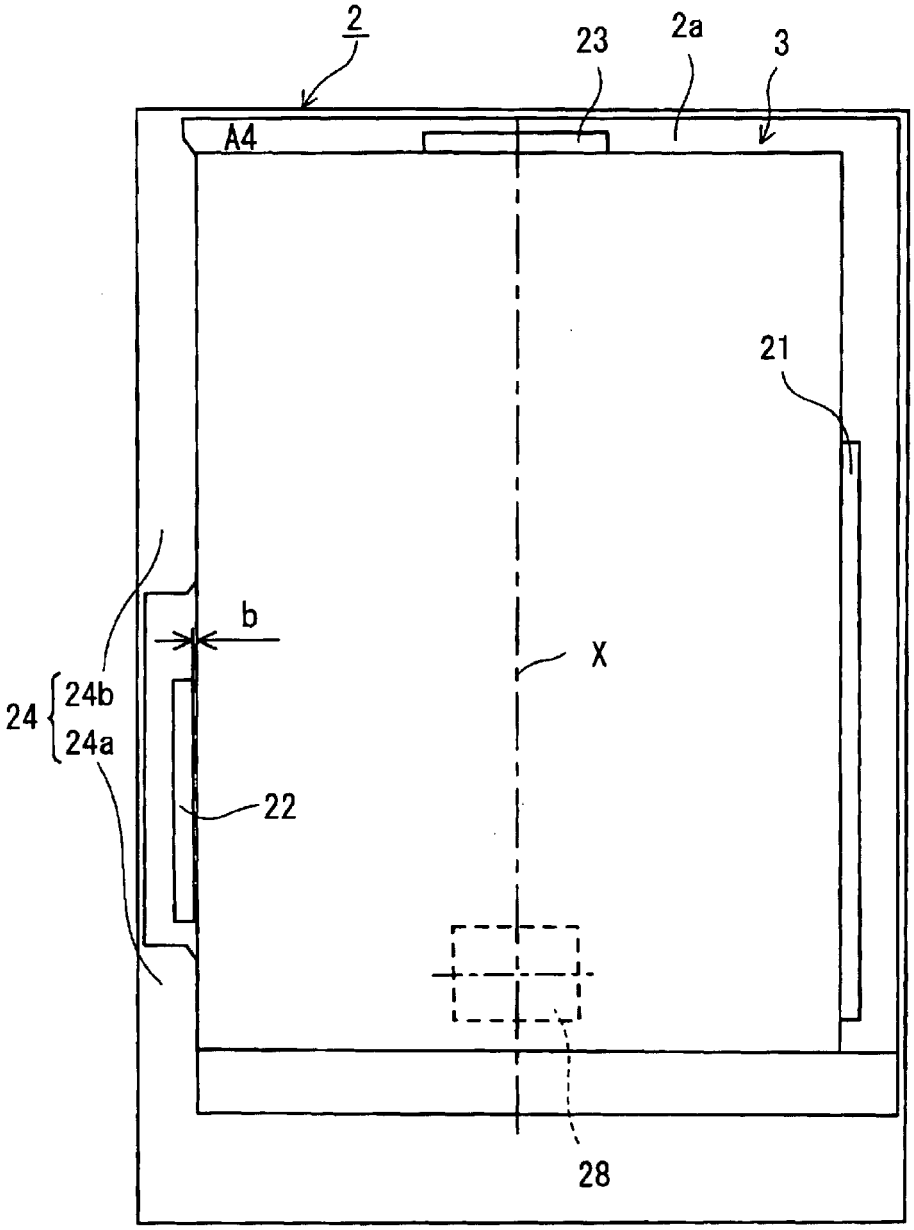
FIG. 7 is a plan view of the sheet feed cassette that shows a positional relation between the sheet guides and A4 size sheets.
Figure 8:
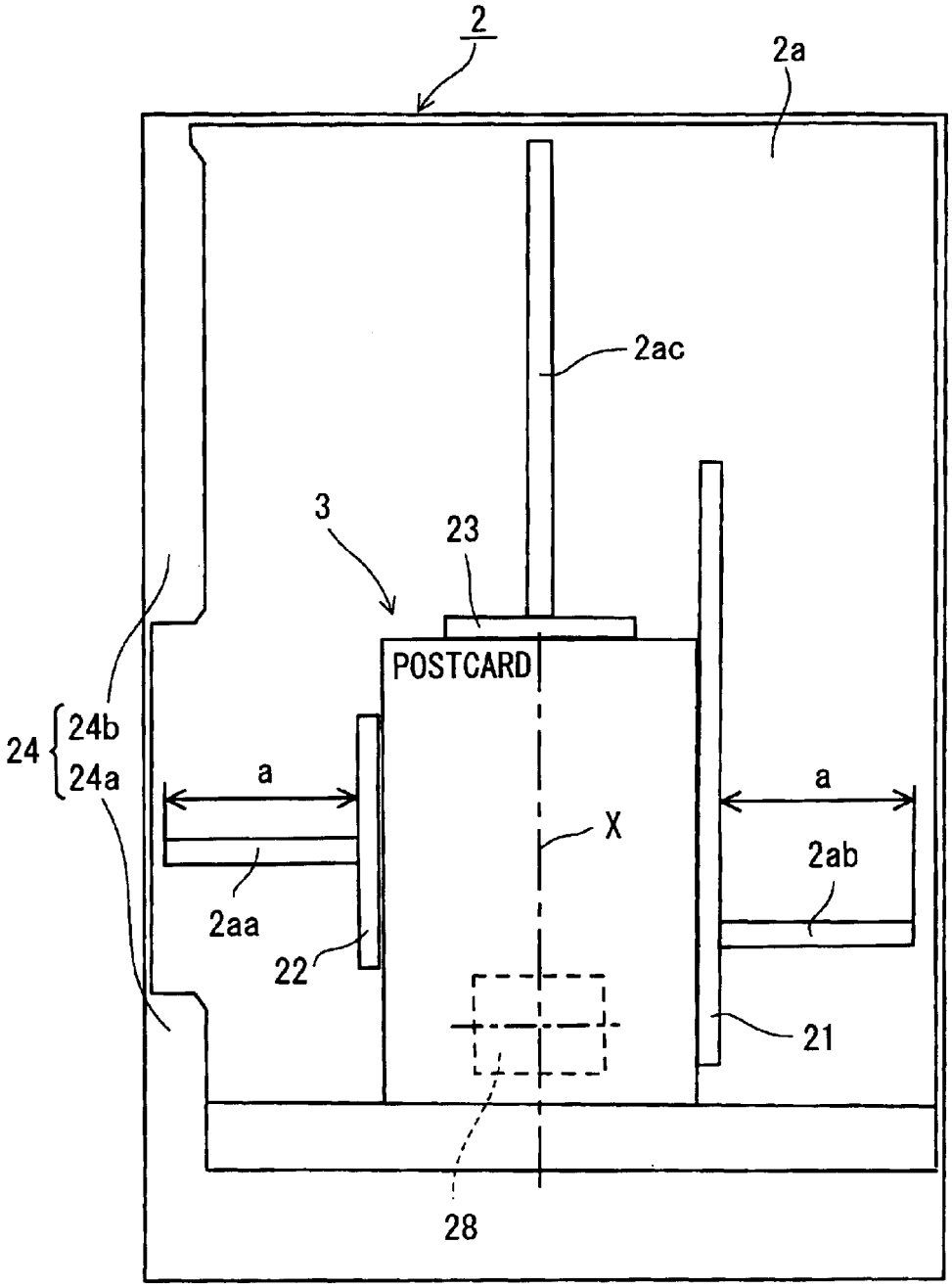
FIG. 8 is a plan view of the sheet feed cassette that shows a positional relation between the sheet guides and postcard size sheets.

FIG. 6 is a plan view of the sheet feed cassette 2 that shows a positional relation of letter (LTR) or legal (LGL) size sheets and the sheet guides. LTR size sheets are equal in width to LGL size sheets but are shorter in length than LGL size sheets. FIG. 7 is a plan view of the sheet feed cassette 2 that shows a positional relation of A4 size sheets and the sheet guides. As shown in FIGS. 7 and 8, LTR or LGL size sheets 3, as well as A4 size sheets 3 are sandwiched and guided by the fixed guide 24 and the first movable guide 21.

As shown in FIG. 6, when LTR or LGL size sheets, which have the largest width among the sheets stackable in the sheet feed cassette 2, are guided, the second movable guide 22 is retracted between the first and second fixed guides 24*a*, 24*b* of the fixed guide 24. The second movable guide 22 is away a sufficient distance from the sheets 3. Likewise, as shown in FIG. 7, when A4 size sheets, which have the predetermined size among the sheets stackable in the sheet feed cassette 2, are guided, the second movable guide 22 is retracted between the first and second fixed guides 24*a*, 24*b* of the fixed guide 24. In this case, the movable guide 22 is away a very small distance b from the sheets 3.

In other words, in FIGS. 6 and 7, the second movable guide 22 is placed farther from the first movable guide 21 than the fixed guide 24, in a direction perpendicular to the sheet feed direction T. This structure allows the sheets 3 having a width equal to or larger than the width of the frequently used predetermined size sheet (A4 size sheet in this embodiment) to be regulated by the fixed guide 24. Thus, the sheets 3 are guided stably by the wobble-free fixed guide 24.

Furthermore, as shown in FIGS. 6 and 7, the first movable guide 21 is disposed to face both the first and second fixed guides 24*a*, 24*b* of the fixed guide 24. The fixed guide 24, which is longer than the first movable guide 21, works with the first movable guide 21, which is shorter than the fixed guide 24. The sheets 3 are pressed by the first movable guide 21 against the fixed guide 24, which is longer than the first movable guide and serves as a reference guide member. Thus, the sheets 3 are guided more stably than when guided by a pair of opposed guides having the same length. The fixed guide 24 divided into the first and second fixed guides 24*a*, 24*b* that are away from each other reduces a frictional load generated between the fixed guide 24 and the edge of each sheet 3 to be fed for printing. The frictional load is reduced because the sheet 3 is guided by the sheet guides 21, 24*a*, 24*b* that make contact with three portions of the sheet 3.

FIG. 8 is a plan view of the sheet feed cassette 2 that shows a positional relation between the sheet guides and postcard size sheets. As shown in FIG. 8, postcard size sheet or sheets that are smaller in width than the predetermined size sheet (A4 size sheet in this embodiment) are sandwiched and guided by the first and second movable guides 21, 22 as in a conventional center registration type sheet guiding system. The first movable guide 21 is always used to guide sheets regardless of the width.

In this case, as shown in FIG. 8, the first and second movable guides 21, 22 are moved by the same distance a. With this structure, the first and second movable guides 21, 22 guide the sheets 3 while centering the sheets 3 with respect to the center line X. As already described, the sheets 3, which are small relative to the length of the first and second movable guides 21, 22, are less likely to be affected by the wobble of the first and second movable guides 21, 22.

In addition, as shown in FIG. 8, the first movable guide 21 is designed to be longer than the second movable guide 22 in this embodiment. The sheets 3 are pressed by the second movable guide 22, which is shorter than the first movable guide 21, against the first movable guide 21, which is longer than the second movable guide 22 and serves as a reference guide member. Thus, the sheets 3 are guided more stably than when guided by a pair of opposed guides having the same length.

If the sheet feed cassette 2 is applied to an image forming device that is capable of duplex printing and provided with a duplex sheet path and a duplex unit, a sheet path for front side printing and a sheet path for revise side printing can be set using the fixed guide 24 as a reference. Thus, in such an image forming device, duplex printing for sheets guided by the fixed guide 24, that is, LTR, LGL, and A4 size sheets, can be performed without the need for providing a sheet feed position adjuster or a position sensor in the duplex unit. Accordingly, duplex printing can be accomplished in a simple structure stably with less chance of sheet skewing.

In contrast, when duplex printing is performed in an image forming device with a conventional center registration type sheet guiding system, the sheet feed position needs to be adjusted depending on the sheet size before reverse side printing. For example, in duplex printing for A4 or LTR size sheets, the sheet feed position is adjusted using a sheet feed position adjuster of a duplex unit, and a position sensor detects the adjusted sheet feed position so that the print start position is controlled. Alternatively, it is possible to set a single intermediate sheet feed position commonly for A4 and LTR size sheets for reverse side printing and eliminate a sheet feed position adjuster or a position sensor. In this case, however, sheet skewing is likely to occur.

Figure 9:
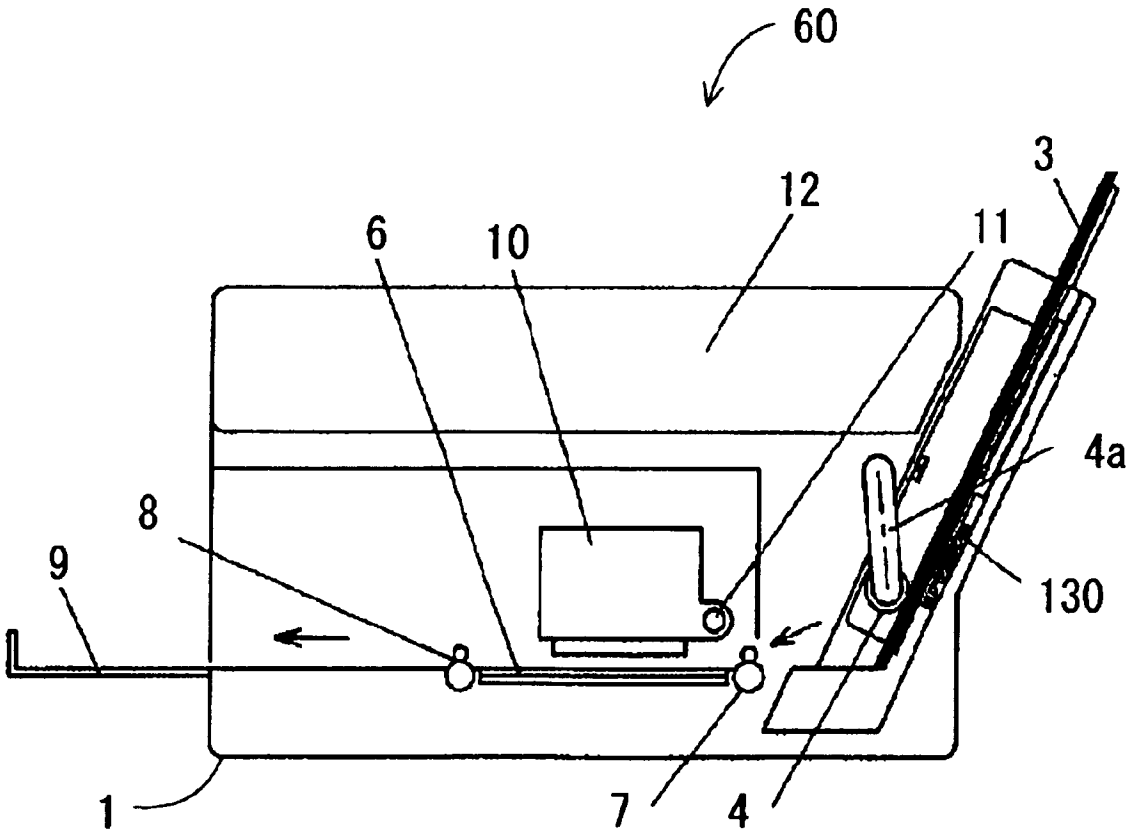
FIG. 9 is a vertical sectional side view showing essential parts of another image forming device according to the invention.
Figure 10B:
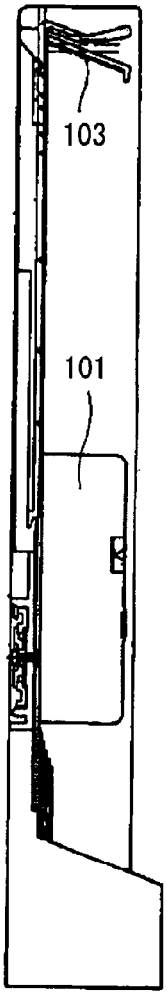
FIG. 10B is a sectional side view of the conventional sheet feed cassette.
Figure 10A:
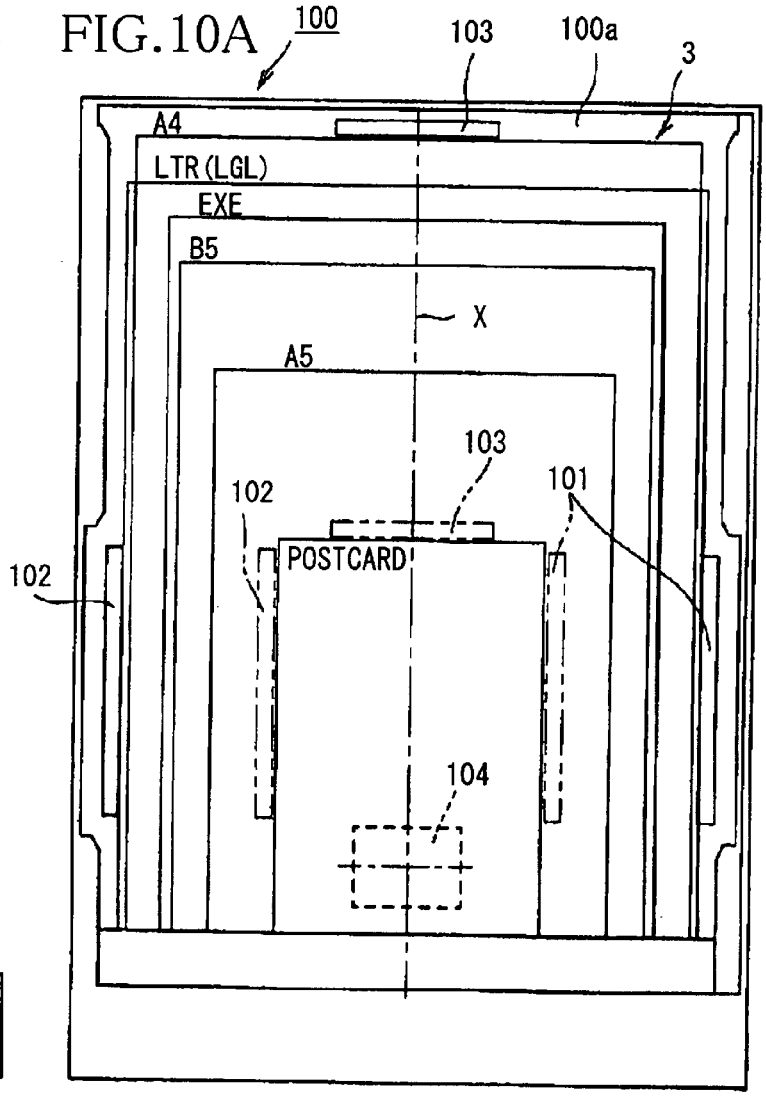
FIG. 10A is a plan view of a conventional sheet feed cassette that shows positional relations between sheet guides and different sized sheets.

FIG. 9 is a vertical sectional side view showing essential parts of another image forming device 60 according to the invention. In the image forming device 60, sheets 3 are fed from an upper portion thereof. In FIG. 9, a sheet feed cassette 130 is disposed at the front end of a housing 1 to extend vertically at an angle with respect to a sheet feed direction. The sheet feed cassette 130 may be formed integrally with the housing 1 or formed separately from the housing 1. Sheets 3 are stacked in the sheet feed cassette 130, and a sheet feed roller 4 is lightly pressed by an arm 4 a against the upper surface of the stack of sheets 3.

A platen 6 is disposed behind the sheet feed cassette 130. A pair of linefeed rollers 7 and a pair of ejecting rollers 8 are disposed at the front and rear of the platen 6, respectively. An output tray 9 is disposed behind the platen 6 to project from the housing 1.

In addition, a printhead 10 that prints on the sheet 3 is disposed right above the platen 6 and is guided to reciprocate along a carriage guide shaft 11 in a direction perpendicular to the sheet feed direction. A document reader 12 is disposed at an upper portion of the housing 1.

A topmost sheet 3 of the stack is fed one by one by its own weight or by a frictional force generated by the rotation of the sheet feed roller 4. Then, the sheet 3 is fed to the platen 6 by the rotation of the linefeed rollers 7, and is guided to the output tray 9 by the rotation of the ejecting rollers 8. When the sheet 3 is carried over the platen 6, the printhead 10 reciprocates along the carriage guide shaft 11 to print an image read by the document reader 12 on the sheet 3.

The sheet feed cassette 130 has the same structure as the sheet feed cassette 2 of the aforementioned embodiment except that the sheet feed cassette 130 is not provided with a rear guide. Because the sheet feed cassette 130 is mounted vertically at an angle, sheets are abutted at their front edges against a font panel of the sheet feed cassette 130 by their own weight. The sheet feed cassette 130 guides different sized sheets in the same manner and with the same effects as in the sheet feed cassette 2.

The sheet guiding systems according to the above-described embodiments are simple in structure yet enables sheet guiding selectively by side or center registration. Different sized sheets are guided by side alignment or centering, depending on the sheet width or dimension, perpendicular to the sheet feed direction, of the sheet. In any case, the sheet feed roller provided substantially at the center of the sheet guiding system contacts a center position of a topmost sheet, thereby stably feeding the sheet. Accordingly, shifting in the sheet guiding position, sheet skewing, or deviation of a printed image are prevented.

Although the invention has been described with reference to specific embodiments, the description of the embodiments is illustrative only and is not to be construed as limiting the scope of the invention. For example, in the above-described embodiments, sheets are oriented in the sheet feed cassette 2 to be guided and fed with their longer side parallel to the sheet feed direction, and the sheets are compared in width with the predetermined size sheet (A4 size sheet). Instead, sheets may be oriented to be guided and fed with their shorter side parallel to the sheet feed direction, and the sheets may be compared in length with the width of the predetermined size sheet (A4 size sheet). In other words, regardless of the orientation of sheets, sheets are guided depending on a sheet dimension, perpendicular to the sheet feed direction.

Although, in the above-described embodiments, the fixed guide 24 is fixed to the sheet feed cassette 2, the fixed guide 24 may be formed as a detachable guide 24. Although the fixed guide 24 is longer than the first movable guide 21, and the first movable guide 21 is longer than the second movable guide 22, either one of pairs of sheet guides 24 and 21, or 21 and 22 may be formed to have the same length. Further, instead of the printhead 10, which is a serial head that moves perpendicularly to the sheet feed direction T, a line head may be used.

Although, the first and second movable guides 21, 22 are movable in association with each other, they may be formed to be movable independently with each other. Alternatively, the first and second movable guides 21, 22 may be formed to be movable in association with each other only when they guide sheets having a width shorter than the width of the predetermined size sheet. In this case, the fixed guide 24*a* nd the first and second movable guides 21, 22 may be used to guide sheets having a width equal to or larger than the width of the predetermined size sheet.

In the above-described embodiments, the first and second movable guides 21, 22 are designed to stop at arbitral positions to guide not only standard sized sheets having a width smaller than the width of an A4 size sheet, such as EXE, B5, A5, and postcard size sheets, but also sheets having a width in the range from the minimum width to the maximum width of the standard sized sheets. Instead, the first and second movable guides 21, 22 may be designed to be click-stopped at positions that correspond to the widths of the standard sized sheets.

The positional relations of the sheet guides are not limited to those shown in FIG. 3. The sheet guides may be arranged reversely with respect to the right-left direction. In the above-described embodiments, the first movable guide 21 is longer than a distance between the first and second fixed guides 24*a*, 24*b*, and the fist movable guide 21 face both the first and second fixed guides 24*a*, 24*b* in a direction perpendicular to the sheet feed direction T. Instead, as long as the first movable guide 21 and the first and second fixed guides 24*a*, 24*b* constitutes three portions with which sheets are guided, the first movable guide 21 may be formed to be shorter than the distance between the first and second fixed guides 24*a*, 24*b* and to face none of them. Or, the first movable guide 21 may be formed to face one of the first and second fixed guides 24, 24*b*.

As should be appreciated, various other modifications and changes may occur without departing from the spirit and scope of the invention.

What is claimed is:

1. A sheet guiding system that guides sheets to be fed in a first direction, comprising:

a sheet tray on which sheets are stacked;

a fixed guide member that is provided on the sheet tray and that is immovable in a second direction perpendicular to the first direction; and a first movable guide member and a second movable guide member that are provided on the sheet tray and that are movable in the second direction perpendicular to the first direction, wherein the second movable guide member is movable relative to the fixed guide member such that the fixed guide member and the first movable guide member, and not the second movable guide member, are used to sandwich and guide the sheets that have a first dimension in the second direction equal to or larger than a predetermined dimension, and the first movable guide member and the second movable guide member are used to sandwich and guide the sheets that have a second dimension in the second direction smaller than the predetermined dimension.

2. The sheet guiding system according to claim 1, wherein the predetermined dimension is a width of an A4 size sheet.

3. The sheet guiding system according to claim 2, wherein a maximum dimension of the sheets guidable in the second direction by the guiding system is larger than the width of the A4 size sheet.

4. The sheet guiding system according to claim 1, wherein when the sheets having the first dimension in the second direction are guided, the second movable guide member is away from the sheets.

5. The sheet guiding system according to claim 1, wherein the fixed guide member has a different length in the first direction than the first movable guide member.

6. The sheet guiding system according to claim 1, wherein the first movable guide member has a different length in the first direction than the second movable guide member.

7. The sheet guiding system according to claim 6, wherein the first movable guide member is longer in the first direction than the second movable guide member.

8. The sheet guiding system according to claim 1, wherein the fixed guide member includes a first fixed guide member and a second fixed guide member and the second movable guide member is movable into a gap between the first fixed guide member and the second fixed guide member.

9. The sheet guiding system according to claim 8, wherein the first movable guide member extends in the first direction and faces both the first fixed guide member and the second fixed guide member in the second direction.

10. The sheet guiding system according to claim 1, wherein the first movable guide member and the second movable guide member are movable equidistantly in opposite directions along the second direction.

11. The sheet guiding system according to claim 10, wherein the first movable guide member and the second movable guide member are movable in association with each other in opposite directions with respect to a center line, extending in the first direction, of the sheet tray.

12. The sheet guiding system according to claim 1, wherein when the fixed guide member and the first movable guide member are used, the fixed guide member is closer than the second movable guide member to the first movable guide member, and a center position of the sheets in the second direction between the fixed guide member and the first movable guide member gets closer to the fixed guide member as a distance in the second direction between the fixed guide member and the first movable guide member decreases.

13. The sheet guiding system according to claim 1, wherein when the first movable guide member and the second movable guide member are used, the second movable guide member is closer than the fixed guide member to the first movable guide member, and a center position of the sheets in the second direction between the first movable guide member and the second movable guide member remains the same as a distance in the second direction between the first movable guide member and the second movable guide member varies.

14. The sheet guiding system according to claim 10, wherein the first movable guide member and the second movable guide member are movable until a distance in the second direction between the first movable guide member and the second movable guide member becomes equal to a minimum dimension of the sheets guidable by the sheet guiding system.

15. The sheet guiding system according to claim 1, wherein at least a part of the fixed guide member is provided downstream of the first movable guide member with respect to the first direction.

16. The sheet guiding system according to claim 1, wherein the sheets are stacked on the sheet tray with their front edges substantially aligned, regardless of a dimension in the first direction of the sheets, and the fixed guide member extends substantially to the front edges of the sheets.

17. The sheet guiding system according to claim 1, further comprising:

a rear guide member that is provided on the sheet tray and that is movable in the first direction to align rear edges of the sheets.

18. The sheet guiding system according to claim 1, wherein the first movable guide member is provided on one side in the second direction of the sheet tray, and the second movable guide member and the fixed guide member are provided on the other side in the second direction of the sheet tray.

19. The sheet guiding system according to claim 1, wherein the fixed guide member includes a first fixed guide member and a second fixed guide member and the sheets are guided at three positions defined by the first fixed guide member, the second fixed guide member and the first movable guide member.

20. The sheet guiding system according to claim 1, wherein the fixed guide member includes a first fixed guide member and a second fixed guide member located downstream from the first fixed guide member in the first direction with the second fixed guide member having a shorter length in the first direction than the first fixed guide member.

21. The sheet guiding system according to claim 1, wherein the fixed guide member includes a first fixed guide member and a second fixed guide member located downstream from the first fixed guide member in the first direction such that the sheets remain in contact with the second fixed guide member for a predetermined distance after the sheets are initially fed in the first direction.

22. An image forming device, comprising:

a printhead that prints an image on sheets; and a sheet guiding system that guides the sheets to be fed in a first direction for printing by the printhead, the sheet guiding system including:

a sheet tray on which the sheets are stacked;

a fixed guide member that is provided on the sheet tray and that is immovable in a second direction perpendicular to the first direction; and a first movable guide member and a second movable guide member that are provided on the sheet tray and that are movable in the second direction perpendicular to the first direction, wherein the second movable guide member is movable relative to the fixed guide member such that the fixed guide member and the first movable guide member, and not the second movable guide member, are used to sandwich and guide the sheets that have a first dimension in the second direction equal to or larger than a predetermined dimension, and the first movable guide member and the second movable guide member are used to sandwich and guide the sheets that have a second dimension in the second direction smaller than the predetermined dimension.

23. The image forming device according to claim 22, wherein the predetermined dimension is a width of an A4 size sheet.

24. The image forming device according to claim 22, wherein the fixed guide member is provided on one side in the second direction of the sheet tray, and the printhead prints using the one side as a reference for printing.

25. The image forming device according to claim 22, wherein the printhead prints serially in the second direction, perpendicularly to the first direction in which the sheets are fed.

26. The image forming device according to claim 25, further comprising a carriage that carries and reciprocates the printhead in the second direction perpendicular to the first direction.

27. The image forming device according to claim 22, further comprising a sheet feed roller that is provided on a downstream side of the sheet tray with respect to the first direction to frictionally contact a center front of a topmost sheet of the sheets on the sheet tray.

28. The image forming device according to claim 22, wherein the printhead is disposed at one of upper and lower positions with respect to the sheet guiding system so as to face the sheets to be fed.

29. A sheet guiding system that guides sheets to be fed in a first direction, comprising:

a sheet tray on which sheets are stacked;

a fixed guide member that is provided on the sheet tray and that is immovable in a second direction perpendicular to the first direction; and a first movable guide member and a second movable guide member that are provided on the sheet tray and that are movable in the second direction perpendicular to the first direction, wherein:

the first movable guide member is provided on one side in the second direction of the sheet tray, and the second movable guide member and the fixed guide member are provided on the other side in the second direction of the sheet tray, when the first movable guide member and the second movable guide member are away from each other in the second direction by a distance equal to or larger than a predetermined distance, the fixed guide member is closer than the second movable guide member to the first movable guide member, and when the first movable guide member and the second movable guide member are away from each other in the second direction by a distance smaller than the predetermined distance, the second movable guide member is closer than the fixed guide member to the first movable guide member.

30. The sheet guiding system according to claim 29, wherein the sheets having a first dimension in the second direction equal to or larger than the predetermined distance are sandwiched and guided by the fixed guide member and the first movable guide, and when the sheets having a second dimension in the second direction smaller than the predetermined distance are sandwiched and guided by the first movable guide member and the second movable guide member.

31. The sheet guiding system according to claim 30, where in the predetermined distance between the first movable guide member and the second movable guide member is a width of an A4 size sheet.

32. A sheet guiding system that guides sheets to be fed in a first direction, comprising:

a sheet tray on which sheets are stacked;

a fixed guide member that is provided on the sheet tray and that is immovable in a second direction perpendicular to a first direction; and a first movable guide member and a second movable guide member that are provided on the sheet tray and that are movable in the second direction perpendicular to the first direction, wherein the fixed guide member has a different length in the first direction than the first movable guide member, and the first movable guide member has a different length in the first direction than the second movable guide member.

33. The sheet guiding system according to claim 32, wherein the fixed guide member is longer in the first direction than the first movable guide member and the first movable guide member is longer in the first direction than the second movable guide member.

* * * * *